US007192295B1

(12) United States Patent
Yeh

(10) Patent No.: US 7,192,295 B1
(45) Date of Patent: Mar. 20, 2007

(54) ANTI-DECOUPLING STRUCTURE FOR USB CONNECTOR

(76) Inventor: Ming-Hsiang Yeh, 14F, No. 375, Nan-Gang District, Fu De Street, Taipei City (TW)

( * ) Notice: Subject to any disclaimer, the term of this patent is extended or adjusted under 35 U.S.C. 154(b) by 0 days.

(21) Appl. No.: 11/448,918

(22) Filed: Jun. 8, 2006

(51) Int. Cl.
*H01R 13/627* (2006.01)

(52) U.S. Cl. ..... 439/350; 439/923

(58) Field of Classification Search ..... 439/350–355, 439/357–358, 923, 607

See application file for complete search history.

(56) References Cited

U.S. PATENT DOCUMENTS 6,056,578 A * 5/2000 Lin ..... 439/358

* cited by examiner

*Primary Examiner*—Javaid H. Nasri
(74) *Attorney, Agent, or Firm*—Troxell Law Office PLLC

(57) ABSTRACT

In an anti-decoupling structure for a USB connector, a hooking device is mounted on a terminal base. A control plate is extended from the hooking device. A hidden lock is mounted behind the control plate. The terminal base, the hidden lock and the hooking device are packaged by the outer shell to form a unity, whereby the USB connectors are protected from being decoupled by using the hooking device. Besides, the hooking device is locked or unlocked by controlling the hidden lock to protect the USB connectors from being stolen.

9 Claims, 6 Drawing Sheets

ANTI-DECOUPLING STRUCTURE FOR USB CONNECTOR

FIELD OF THE INVENTION

The present invention relates to an anti-decoupling structure to protect USB connectors from being decoupled by pull and drag, and more particularly to an anti-decoupling structure applicable for all kinds of wire, connector, conversion connector, conversion wire, connector of related apparatus, or the like.

BACKGROUND OF THE INVENTION

The USB (Universal Serial Bus) connectors are currently very popular. Referring to FIG. 7, the USB connectors are easy to use. However, when a need exists in coupling a male plug B with a female socket A, an outer frame B2 of a terminal base (not shown) of the male plug B is hooked and confined merely by an outer frame A2 of a terminal base A1 of the female socket A so as to contact these two terminal bases with each other for transmitting signal.

The coupled USB connectors are able to provide good signal transmission. However, the coupled USB connectors, which are provided with no anti-decoupling structure, may be decoupled easily by inadvertent pull and drag, causing negative influence on signal transmission.

Whereas the foregoing description, the present inventor makes diligent studies in providing the consumers with an anti-decoupling structure to protect the USB connectors from being decoupled by pull and drag, thereby preventing the signal transmission from being affected.

SUMMARY OF THE INVENTION

It is a main object of the present invention to provide an anti-decoupling structure to protect USB connectors from being decoupled by external force to further prevent the signal transmission from being affected.

It is another object of the present invention to provide an anti-decoupling structure with a hidden lock.

In order to achieve the above-mentioned objects, a hooking device is mounted on a terminal base. A control plate is extended from the hooking device. A hidden lock is mounted behind the control plate. The terminal base, the hidden lock and the hooking device are packaged by the outer shell to form a unity. Besides, the hooking device is locked or unlocked by controlling the hidden lock to avoid stealing.

The aforementioned objects and advantages of the present invention will be readily clarified in the description of the preferred embodiments and the enclosed drawings of the present invention.

DETAILED DESCRIPTION OF THE PREFERRED EMBODIMENT

Figure 1:
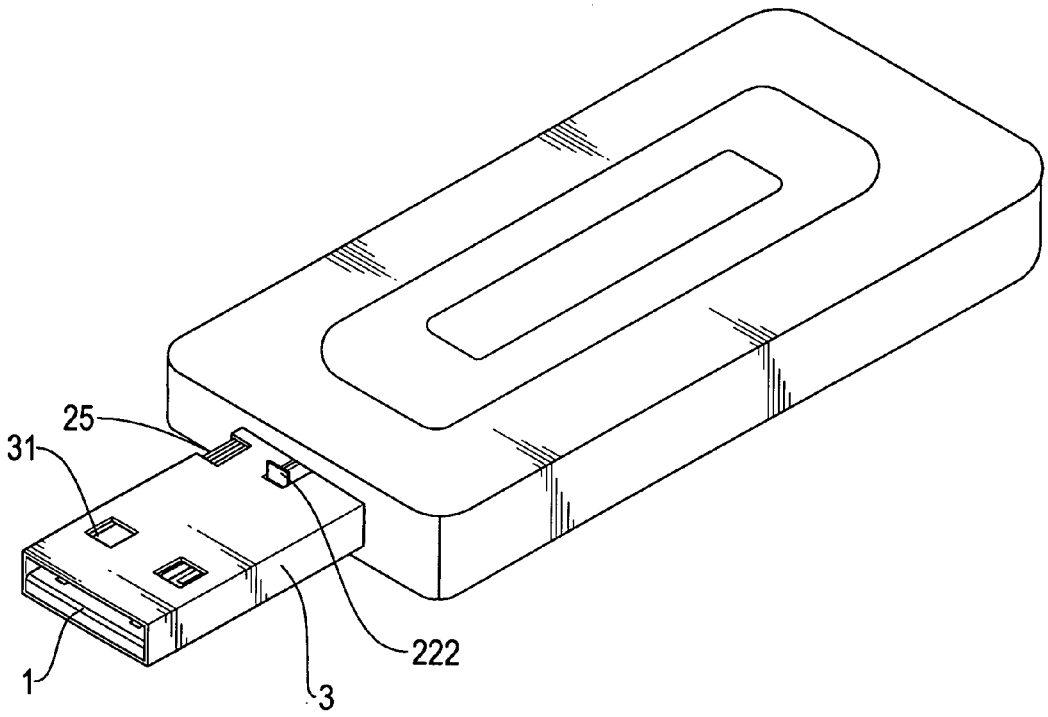
FIG. 1 is a three-dimensional view showing a first preferred embodiment of the present invention.
Figure 2:
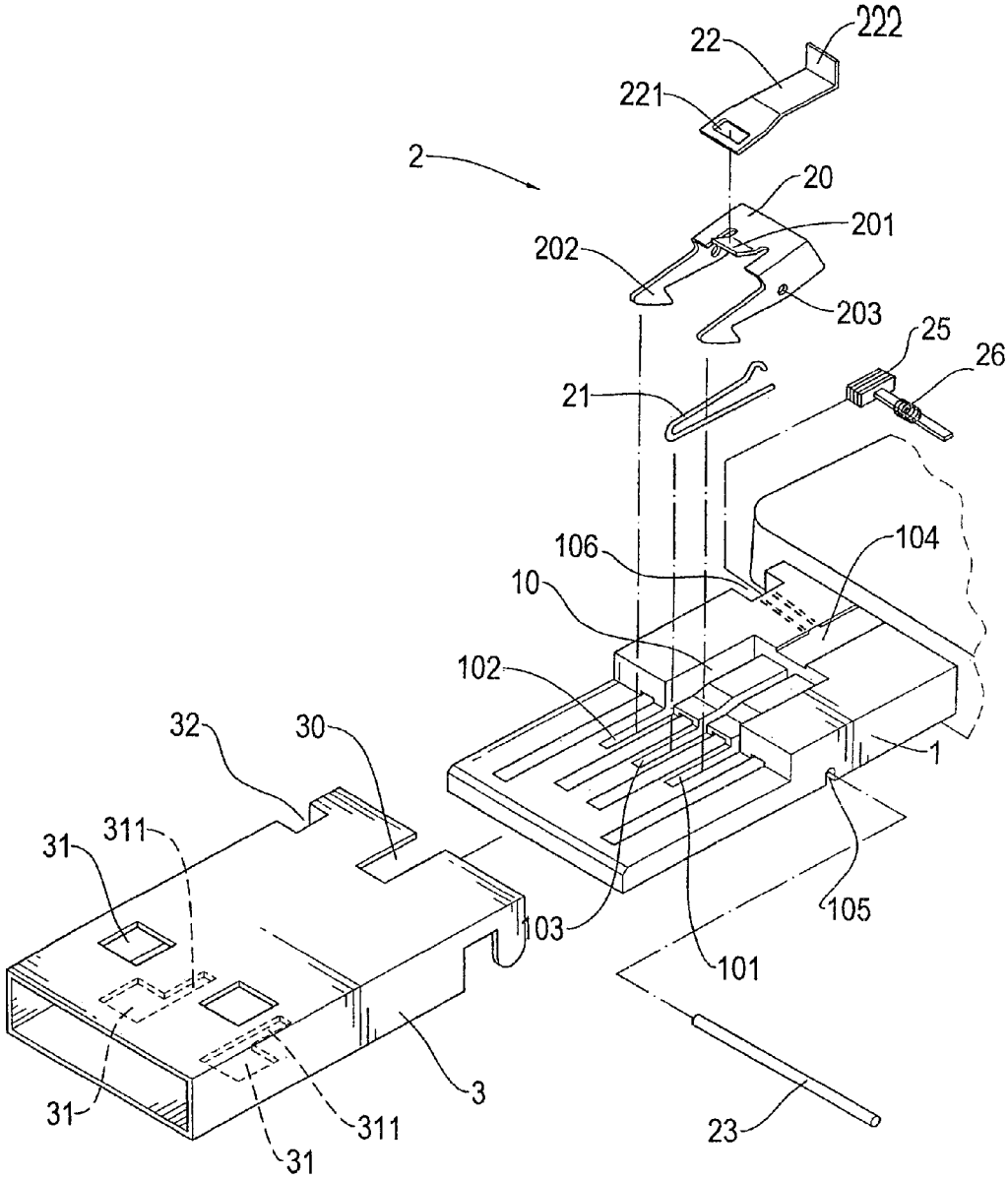
FIG. 2 is an exploded view showing the components of the first preferred embodiment of the present invention.
Figure 3:
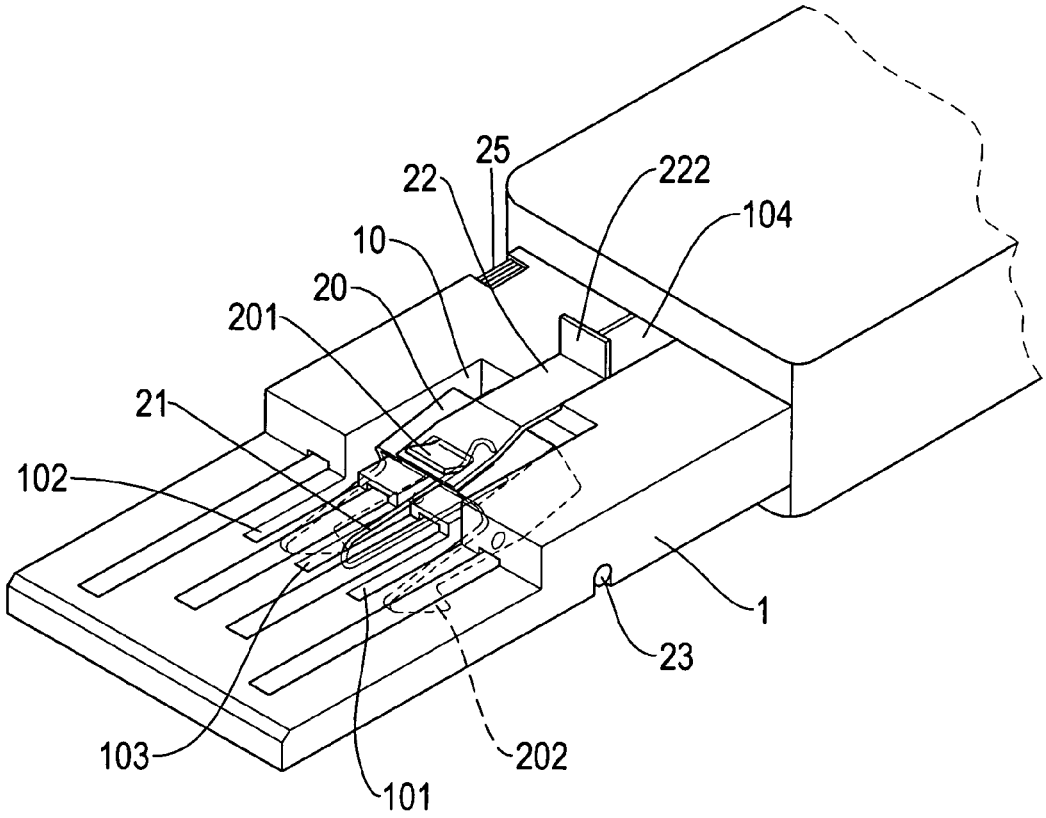
FIG. 3 is a three-dimensional view showing the hooking device attached to the terminal base.

Referring simultaneously to FIG. 1, FIG. 2 and FIG. 3, the present invention is applied to a USB connector mounted on a connecting wire or a portable disk. For the purpose of explanation, the USB connector is mounted on a MP3 device according to this preferred embodiment. The USB connector of this MP3 device comprises a terminal base 1 on which several contact terminals are mounted, a hooking device 2 and an outer shell 3. Besides, a notch 10 is formed on an upper middle section of the terminal base 1. Three rectangular through trenches 101, 102 and 103 are formed on both sides and the center of the notch 10, respectively. In addition, a shaft hole 105, which penetrates through the bottom of the notch 10, is formed on a middle section of the bottom of the terminal base 1. A trench 104 is formed on the terminal base 1 behind the notch 10. Besides, a notch 106 is formed on a lateral rearward of the terminal base 1. A through hole, which penetrates through the trench 104 perpendicularly, is formed on the bottom of the notch 106. A rod 251 is extended from the bottom of the press-button 25 for insertion into the notch 106, and a spring 26 is sleeved onto the rod 251.

The hooking device 2 comprises a hooking plate 20, a spring 21, a control plate 22 and a shaft 23, wherein the hooking plate 20 is a reverse U-shaped frame having an upward bended connection plate 201 on a center section for insertion into a through hole 221 formed on one end of the control plate 22. Besides, a bended part 222 is formed on the other end of the control plate 22. Two hooked rods 202, each having a downward hook, are protrudent forward from both lateral walls of the reverse U-shaped frame, respectively. Besides, two shaft holes 203 are formed oppositely on the respective lateral walls of the reverse U-shaped frame for insertion of the shaft 23. The spring 21 is a long arc-shaped spring with an included angle.

The outer shell 3 is fitted for the terminal base 1, and two through holes 31 are formed oppositely on both top and bottom surfaces of the outer shell 3. Besides, two extension trenches 311 are formed adjacent to the respective inner edges of the through holes 31, which are formed on the bottom of the outer shell 3. A notch 30 is formed properly on a rearward of a top surface of the shell 3, and another notch 32 is formed beside the notch 30.

In the assembly process, the spring 21 and the hooking plate 20 are inserted into the notch 10 from the top of the terminal base 1 such that the spring 21 is located inside the through trench 103 and that the lateral walls and the hooked rods 202 of the hooking plate 20 are inserted into the through trenches 101 and 102, respectively. Besides, the shaft 23 is inserted into the shaft hole 105 of the terminal base 1 for pivotally coupling the hooking plate 20 with the notch 10 of the terminal base 1. Besides, the connection plate 201 of the hooking plate 20 is inserted into the through hole 221 formed on a front end of the control plate 22 such that a rear end of the control plate 22 is located in the trench 104 of the terminal base 1. Finally, the terminal base 1 and the hooking device 2 are packaged by the outer shell 3 in a manner that the notches 30 and 32 of the outer shell 3 are located to aim at the trench 104 and notch 106 of the terminal base 1 for completing the assembly of the present invention.

Figure 4:
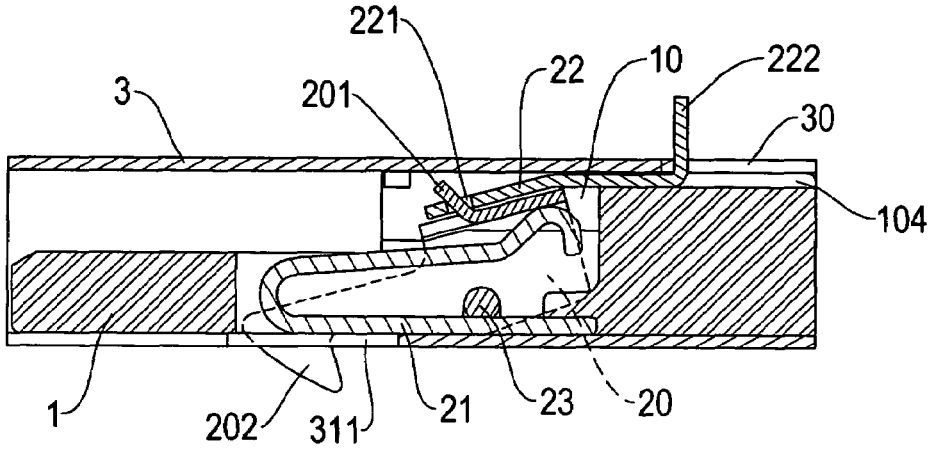
FIG. 4 and FIG. 5 are cross-sectional views showing the assembly process of the first preferred embodiment of the present invention.

Referring to FIG. 4, the spring 21 is confined between the outer shell 3 and the hooking plate 20. In a normal condition, the spring 21 is against the rearward of the connection plate of the hooking plate 20 so that the hooked rods 202 of the hooking plate 20 are extended to the outside of the through holes 31 and the extension trenches 311 as a result of the pivotal connection between the shaft 23 and the hooking plate 20. Accordingly, when the USB connector of the present invention couples with another corresponding USB connector, the hooked rods 202 are able to hook the corresponding through holes of this corresponding USB connector for positioning them. Furthermore, if the coupled USB connectors are pulled and dragged inadvertently, the USB connectors will not be decoupled since the corresponding through holes are hooked tightly by the hooked rods 202.

Moreover, after the press-button 25 is pressed, the rod 251 located on the bottom of the press-button 25 is inserted into the trench 104 to prevent backward movement of the control plate 22, thereby avoiding inward movement of the hooked rods 202, which are located on both sides of the hooking plate 20, to protect the USB connectors from being decoupled. As a result, the MP3 device will not be stolen easily by a bad person.

Figure 5:
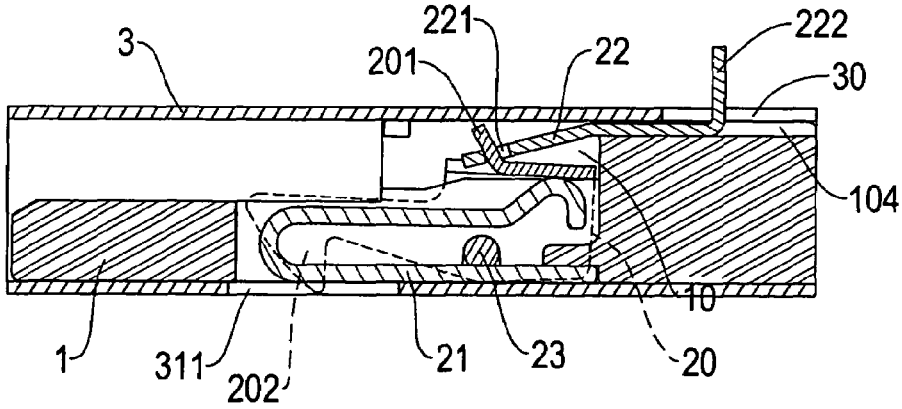

If a need exists in detaching these two USB connectors, the press-button 25 is released first to retrieve the position of the rod 251 and to prevent it from insertion into the trench 104. Referring to FIG. 5, at this moment, a backward force may be applied to the bended part 222 of the control plate 22 to allow the movement of the control plate 2 in the trench 104 and the notch 30. The connection plate 201 is driven by the movement of the control plate 22 to rotate the hooking plate 20 since the hooking plate 20 is pivotally fixed by the shaft 23, such that the hooked rods 202 can be lifted upward to be embedded into the terminal base 1. As a result, the corresponding through holes are not hooked by the hooked rods 202. Accordingly, these two USB connectors can be separated easily by applying respective backward forces to them.

Figure 6:
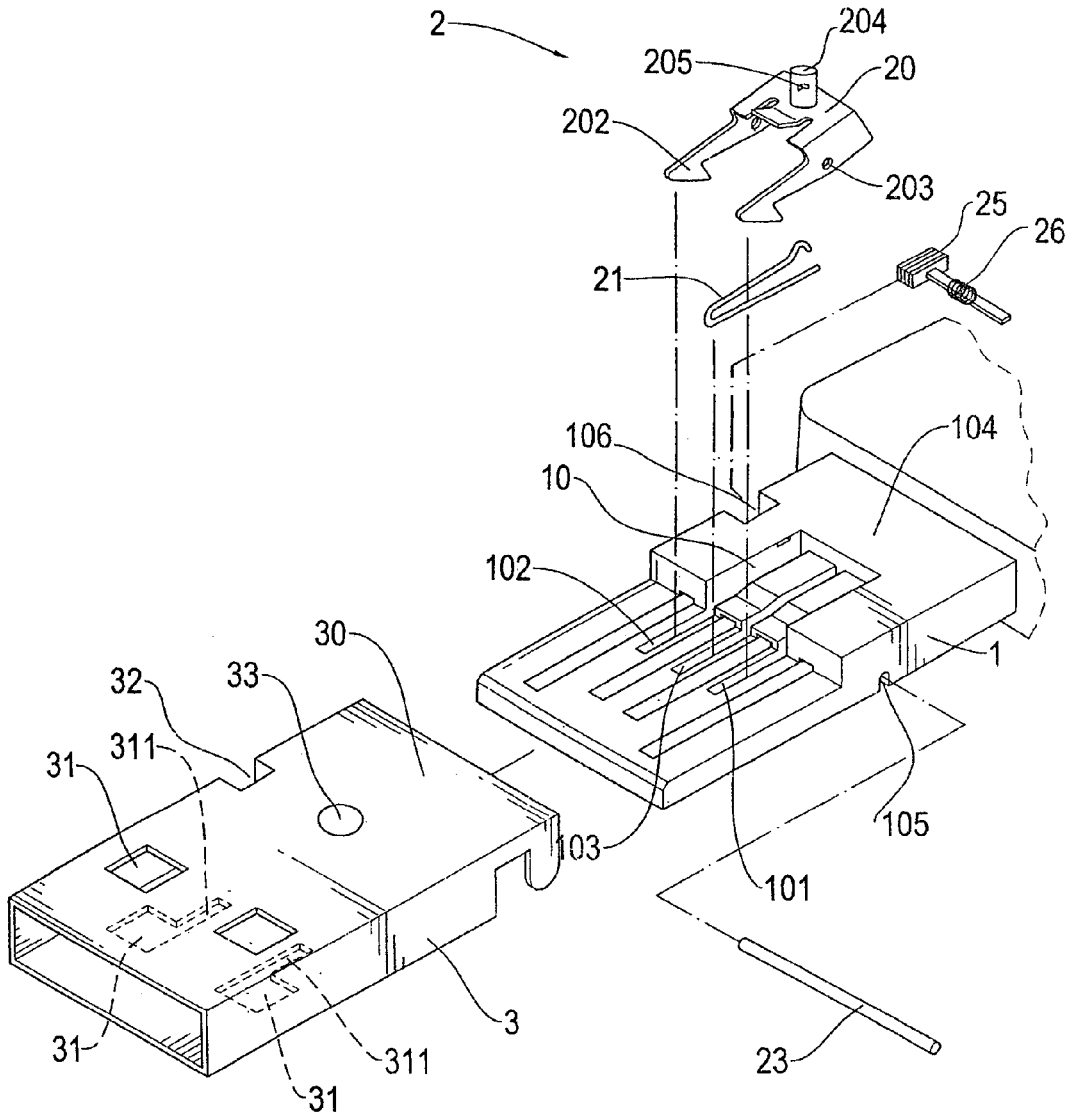
FIG. 6 is a three-dimensional view showing a second preferred embodiment of the present invention.
Figure 7:
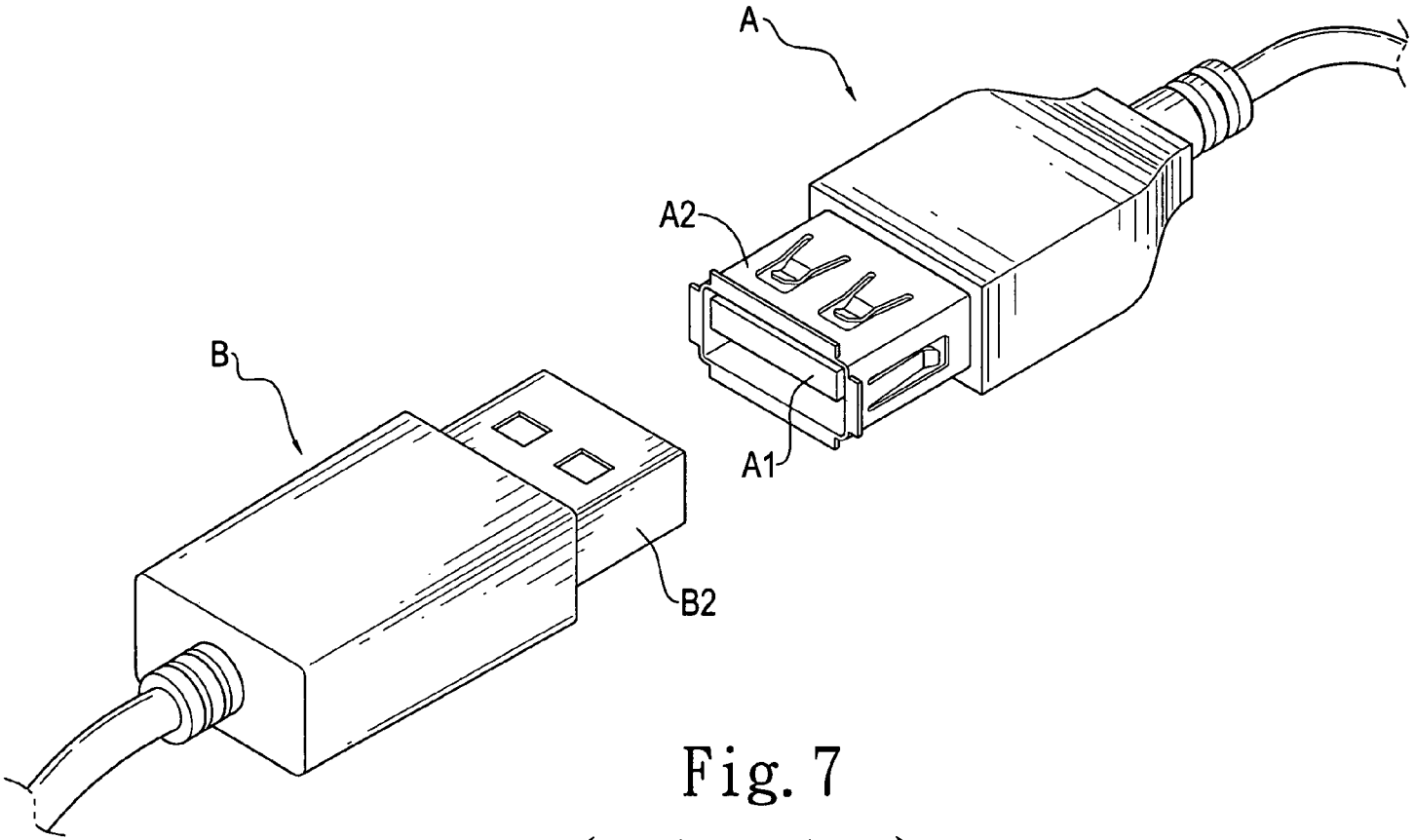
Fig. 7 (Prior Art)
FIG. 7 is a three-dimensional view showing the conventional USB connectors.

As shown in FIG. 6, a second preferred embodiment of the present invention is shown. The MP3 connector comprises a terminal base 1 having several contact terminals mounted thereon, a hooking device 2 and an outer shell 3. Besides, a notch 10 is formed on an upper middle section of the terminal base 1. Three rectangular through trenches 101, 102 and 103 are formed on both sides and the center of the notch 10, respectively. In addition, a shaft hole 105, which penetrates through the bottom of the notch 10, is formed on a middle section of the bottom of the terminal base 1. Besides, a notch 106 is formed on the terminal base 1 beside the notch 10. A through hole, which penetrates through the notch 10 perpendicularly, is formed on the bottom of the notch 106. A press-button 25 having a rod 251 extending from the bottom thereof is inserted into the notch 106, and a spring 26 is sleeved onto the rod 251.

The hooking device 2 comprises a hooking plate 20, a spring 21 and a shaft 23, wherein the hooking plate 20 is a reverse U-shaped frame having a press-button 204 protrudent from a rearward of a center section thereof. A positioning hole 205 is formed on the press-button 204. Two hooked rods 202, each having a downward hook, are protrudent forward from both lateral walls of the reverse U-shaped frame, respectively. Besides, two shaft holes 203 are formed oppositely on the respective lateral walls of the reverse U-shaped frame for insertion of the shaft 23. The spring 21 is a long arc-shaped spring with an included angle.

The outer shell 3 is fitted for the terminal base 1, and two through holes 31 are formed oppositely on both top and bottom surfaces of the outer shell 3. Besides, two extension trenches 311 are formed adjacent to the respective inner edges of the through holes 31, which are formed on the bottom of the outer shell 3. Besides, a through hole 33 and a notch 32 are formed correspondingly on the outer shell 3.

In the assembly process, the spring 21 and the hooking plate 20 are inserted into the notch 10 from the top of the terminal base 1 such that the spring 21 is located inside the through trench 103 and that the lateral walls and the hooked rods 202 of the hooking plate 20 are inserted into the through trenches 101 and 102, respectively. Besides, the shaft 23 is inserted into the shaft hole 105 of the terminal base 1 for pivotally coupling the hooking plate 20 with the notch 10 of the terminal base 1. As are result, the positioning hole 205 of the press-button 204 of the hooking plate is located to face the press-button 25 directly. Finally, the terminal base 1 and the hooking device 2 are packaged by the outer shell 3 in a manner that the through hole 33 and the notch 32 of the outer shell 3 are located to aim at the press-button 204 of the hooking plate 20 and the notch 106 of the terminal base 1. Consequently, the MP3 connector is prevent from being decoupled by controlling the insertion of the press-button 25, which further controls the insertion of the press-button 204.

In accordance with the foregoing description, it is apparent that the present invention provides the following practical advantages, wherein:

1. the coupled USB connectors will not be decoupled or separated easily by using the hooking device to hook the corresponding USB connector, 2. the hooking plate is rotated by pulling back the control plate such that the hooked rods of the hooking plate are shrunk inward in a seesaw manner to facilitate the separation of the USB connectors, and 3. the extension rod, which is extended from the bottom of the press-button, can be inserted into the trench of the terminal base by pressing the press-button, and the hooking abilities of the hooked rods located on both sides of the hooking plate can be controlled precisely to effectively protect the apparatus on which the USB connector is mounted from being stolen.

In summary, the present invention indeed achieves the expected objects by disclosing the anti-decoupling structure, which is provided with positioning ability and is able to protect USB connectors from being stolen or decoupled easily. Accordingly, the present invention satisfies the requirement for patentability and is therefore submitted for a patent.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments, which do not depart from the spirit and scope of the invention.

What the invention claimed is:

1. An anti-decoupling structure for a USB connector comprising:

a terminal base having a plurality of contact terminals, a first notch having a plurality of through trenches, a shaft hole formed on a middle section of a bottom thereof to penetrate through said first notch, a trench formed behind said first notch, and a second notch having a through hole for penetrating through said trench perpendicularly;

a press-button having an extension rod extending from the bottom thereof for being disposed in said second notch of said terminal base after insertion into a first spring;

a hooking device comprising a hooking plate having two hooked rods and two shaft holes, a second spring, a control plate, and a shaft, said hooking plate and said second spring being disposed in said first notch, said shaft holes of said hooking plate being aligned with said shaft hole of said terminal base for insertion of said shaft, and said control plate being disposed in said trench, whereby said hooking plate is rotated by the movement of said control plate; and an outer shell fitting for said terminal base, said outer shell having two through holes formed oppositely on each of top and bottom surfaces thereof and two extension trenches formed adjacent to respective inner edges of said through holes on said bottom surface, whereby said terminal base, said press-button and said hooking device are packaged by said outer shell so as to expose said hooked rods of said hooking device to the outside of said outer shell.

2. The anti-decoupling structure for the USB connector of claim 1, wherein said hooking plate of said hooking device has an upward bended connection plate on a top surface thereof for coupling with said control plate, and each of said hooked rods is extended forward from said hooking plate and has a downward hook.

3. The anti-decoupling structure for the USB connector of claim 1, wherein said first notch of said terminal base has three rectangular through trenches for holding said hooked rods of said hooking plate and said second spring.

4. The anti-decoupling structure for the USB connector of claim 1, wherein said extension rod, which is extended from the bottom of said press-button, is inserted into said trench by pressing said press-button located in said second notch of said terminal base.

5. The anti-decoupling structure for the USB connector of claim 1, wherein said second spring is an arc-shaped spring with an included angle fitting for said through trenches of said first notch of said terminal base.

6. The anti-decoupling structure for the USB connector of claim 1, wherein said control plate is a rectangular plate having a through hole on a slanted section on one end thereof and a vertically bended part on the other end thereof.

7. The anti-decoupling structure for the USB connector of claim 1, wherein a third notch is formed on a rearward of said top surface of said outer shell to allow the movement of said control plate.

8. An anti-decoupling structure for a USB connector comprising:

a terminal base having a plurality of contact terminals, a first notch having a plurality of through trenches and a through hole, a shaft hole formed on a middle section of the bottom thereof to penetrate through said first notch, and a second notch having a through hole on the bottom thereof formed beside said first notch, and a first press-button having an extension rod and a spring on the bottom thereof being located beside said second notch;

a hooking device comprising a hooking plate having two hooked rods and two shaft holes, a second spring, and a shaft, said hooking plate and said second spring being disposed in said first notch of said terminal base, said shaft holes of said hooking plate being aligned with said shaft hole of said terminal base for insertion of said shaft so as to pivotally couple said hooking plate to said middle section of said terminal base, and a second press-button being protruded from the rear of said hooking plate, whereby said hooked rods of said hooking plate is upward rotatable by pressing said second press-button; and an outer shell fitting for said terminal base, said outer shell having two through holes formed oppositely on each of top and bottom surfaces thereof and two extension trenches formed adjacent to respective inner edges of said through holes on said bottom surface, whereby said terminal base, said press-buttons and said hooking device are packaged by said outer shell so as to expose said hooked rods of said hooking device to the outside of said outer shell.

9. The anti-decoupling structure for the USB connector of claim 8, wherein a positioning hole is formed on said second press-button of said hooking plate of said hooking device.

* * * * *